US011658424B2

(12) United States Patent
Bracey et al.

(10) Patent No.: US 11,658,424 B2
(45) Date of Patent: May 23, 2023

(54) DEPLOYABLE REFLECTOR FOR AN ANTENNA

(71) Applicant: Oxford Space Systems Limited, Didcot (GB)

(72) Inventors: Richard Bracey, Hazlemere (GB); Juan Reveles, Longworth (GB)

(73) Assignee: Oxford Space Systems Limited, Didcot (GB)

( * ) Notice: Subject to any disclaimer, the term of this patent is extended or adjusted under 35 U.S.C. 154(b) by 0 days.

(21) Appl. No.: 17/254,667

(22) PCT Filed: Jun. 28, 2019

(86) PCT No.: PCT/GB2019/051838
§ 371 (c)(1),
(2) Date: Dec. 21, 2020

(87) PCT Pub. No.: WO2020/002939
PCT Pub. Date: Jan. 2, 2020

(65) Prior Publication Data

US 2021/0367348 A1 Nov. 25, 2021

(30) Foreign Application Priority Data

Jun. 28, 2018 (GB) ..... 1810641

(51) Int. Cl.
*H01Q 15/16* (2006.01)
*H01Q 1/28* (2006.01)
*H01Q 15/14* (2006.01)

(52) U.S. Cl.
CPC ..... *H01Q 15/168* (2013.01); *H01Q 1/288* (2013.01); *H01Q 15/141* (2013.01); *H01Q 15/161* (2013.01)

(58) Field of Classification Search
CPC .... H01Q 1/288; H01Q 15/141; H01Q 15/142; H01Q 15/144; H01Q 15/147;
(Continued)

(56) References Cited

U.S. PATENT DOCUMENTS 5,885,906 A 3/1999 Reynolds et al.
6,384,800 B1 * 5/2002 Bassily ..... H01Q 15/168 343/915

(Continued)

FOREIGN PATENT DOCUMENTS

CN 107221755 A 9/2017
EP 595418 A1 * 5/1994 ..... H01Q 15/142

(Continued)

OTHER PUBLICATIONS

European Patent Office, International Search Report and Written Opinion, dated Sep. 25, 2019.

(Continued)

*Primary Examiner* — Ab Salam Alkassim, Jr.
*Assistant Examiner* — Leah Rosenberg
(74) *Attorney, Agent, or Firm* — Umberg Zipser LLP; Ryan Dean

(57) ABSTRACT

A deployable reflector for an antenna is disclosed. The deployable reflector comprises a deployable membrane configured to adopt a pre-formed shape in a deployed configuration, and an electrically conductive mesh disposed on a surface of the membrane wherein the electrically conductive mesh is configured to permit relative lateral movement between the electrically conductive mesh and the membrane during deployment of the reflector. In the deployed configuration, the conductive mesh adopts the shape of the membrane and forms a reflective surface of the reflector. A method of manufacturing the deployable reflector is also disclosed.

18 Claims, 3 Drawing Sheets

(58) Field of Classification Search
CPC .... H01Q 15/148; H01Q 15/16; H01Q 15/161; H01Q 15/162; H01Q 15/163; H01Q 15/165; H01Q 15/166; H01Q 15/167; H01Q 15/168; H01Q 15/18; H01Q 15/20; H01Q 15/22; H01Q 15/23
See application file for complete search history.

(56) References Cited

U.S. PATENT DOCUMENTS

| | | | | |
|---|---|---|---|---|
| 2004/0009728 | A1* | 1/2004 | Kubomura | B29C 70/22 442/205 |
| 2013/0207880 | A1* | 8/2013 | Taylor | H01Q 15/20 343/915 |
| 2015/0194733 | A1* | 7/2015 | Mobrem | H01Q 15/161 343/915 |
| 2017/0025745 | A1* | 1/2017 | Clayton | H01Q 1/1235 |
| 2017/0201031 | A1* | 7/2017 | Gelb | H01Q 13/0283 |

FOREIGN PATENT DOCUMENTS

| | | | |
|---|---|---|---|
| EP | 1168498 | A2 | 1/2002 |
| WO | 1999014821 | A1 | 3/1999 |
| WO | 2017120478 | A1 | 7/2017 |

OTHER PUBLICATIONS

Intellectual Property India, Examination Report, Dispatched Oct. 10, 2022.

* cited by examiner

DEPLOYABLE REFLECTOR FOR AN ANTENNA

TECHNICAL FIELD

The present invention relates to deployable reflectors for antennas.

BACKGROUND

Deployable structures are widely used in satellites and other space applications. Such structures allow the physical size of an apparatus to be reduced for loading into a payload bay of a launch vehicle. Once in orbit and released from the payload bay, the structure can be deployed into a larger configuration to increase the overall dimensions of the apparatus. For example, deployable structures may be capable of being unfolded, extended or inflated.

Deployable antenna reflectors have been developed which comprise a deployable backing structure and a metal mesh. The deployable backing structure forms the metal mesh into a parabolic shape, to act as a reflector in an antenna. The deployable backing structure serves two purposes: firstly, it provides a mechanism to deploy the metal mesh once in orbit; and secondly, it provides a thermo-elastically stable platform for the reflector. Since the metal mesh possesses no inherent stiffness, a complex collection of tensioning elements and cable network structures are thus required to shape the metal mesh in-situ into its desired configuration.

Conventional mesh-based deployable reflectors suffer from a number of drawbacks. The cable network only shapes the metal mesh locally, at the points where the cables attach to the mesh, creating pillowing and faceting effects in all other areas of the metal mesh. As a result, the final shape of the reflector may only approximate an ideal paraboloid. Also, cable network structures are complex to design and manufacture, and can increase the risk of entanglement during deployment.

The invention is made in this context.

SUMMARY OF THE INVENTION

According to a first aspect of the present invention, there is provided a deployable reflector for an antenna, the deployable reflector comprising a deployable membrane configured to adopt a pre-formed shape in a deployed configuration, and an electrically conductive mesh disposed on a surface of the membrane such that in the deployed configuration, the conductive mesh adopts the shape of the membrane and forms a reflective surface of the reflector wherein the electrically conductive mesh is configured to permit relative lateral movement between the electrically conductive mesh and the membrane during deployment of the reflector.

In some embodiments according to the first aspect, the membrane comprises an open-cell woven material. For example, the open-cell woven material may have a triaxial weave structure. In some embodiments, the open-cell woven material comprises a weave of para-aramid fibres embedded in a silicone matrix.

In some embodiments according to the first aspect, the electrically conductive mesh is arranged to be disposed on a convex surface of the deployable membrane in the deployed configuration, such that during deployment of the reflector the deployable membrane presses into and deforms the electrically conductive mesh into the pre-formed shape.

In some embodiments according to the first aspect, the membrane is formed of material that is transparent to electromagnetic radiation at radio-frequency wavelengths.

In some embodiments according to the first aspect, the electrically conductive mesh is configured to permit relative lateral movement between the electrically conductive mesh and the membrane during deployment of the reflector.

In some embodiments according to the first aspect, the deployable membrane is a first membrane, and the electrically conductive mesh is disposed between the membrane and a second membrane.

In some embodiments according to the first aspect, the deployable reflector comprises a plurality of first connecting members configured to connect the mesh to the membrane.

In some embodiments according to the first aspect, each first connecting member comprises a flexible connector in the form of a loop configured to secure one or more fibres of the mesh to the membrane.

In some embodiments according to the first aspect, each first connecting member is formed of an elastic material capable of stretching to permit relative lateral movement between the mesh and the membrane.

In some embodiments according to the first aspect, a length of the loop in each first connecting member is longer than a minimum distance required to encircle the one or more fibres of the mesh, such that slack in the loop can be taken up during relative lateral movement between the mesh and the membrane.

In some embodiments according to the first aspect, the deployable reflector further comprises a plurality of second members passing through the electrically conductive mesh, each one of the plurality of second members being connected to the first and second membranes to maintain a spacing between the first and second membranes during deployment of the reflector.

In some embodiments according to the first aspect, the membrane is configured to provide a continuous three-dimensional curved surface for shaping the electrically conductive mesh in the deployed configuration.

In some embodiments according to the first aspect, the deployable reflector is configured as a shaped reflector for a contoured-beam antenna, wherein in the deployed configuration the three-dimensional curved surface of the membrane includes a plurality of regions of different curvatures so as to produce a beam having an irregular pattern.

According to a second aspect of the present invention, there is provided an unfurlable antenna comprising a deployable reflector according to the first aspect.

In some embodiments according to the second aspect, the unfurlable antenna further comprises a backing structure configured to deploy the deployable reflector.

According to a third aspect of the present invention, there is provided a satellite comprising an unfurlable antenna according to the second aspect.

According to a fourth aspect of the present invention, there is provided a method of manufacturing a deployable reflector for an antenna, the method comprising pre-forming a deployable membrane on a mould, such that in a deployed configuration the membrane adopts the shape of the mould, and disposing an electrically conductive mesh on the self-supporting membrane such that in the deployed configuration, the conductive mesh adopts the shape of the membrane and forms a reflective surface of the reflector, wherein the electrically conductive mesh is configured to permit relative lateral movement between the electrically conductive mesh and the membrane during deployment of the reflector.

In some embodiments according to the fourth aspect, pre-forming the deployable membrane comprises laying an open-cell woven material on the mould, applying a gel to the open-cell woven material, before or after laying the open-cell woven material on the mould, and curing the gel to form a solid matrix around the open-cell woven material, whilst the membrane remains on the mould.

BRIEF DESCRIPTION OF THE DRAWINGS

Embodiments of the present invention will now be described, by way of example only, with reference to the accompanying drawings, in which.

DETAILED DESCRIPTION

Figure 1:
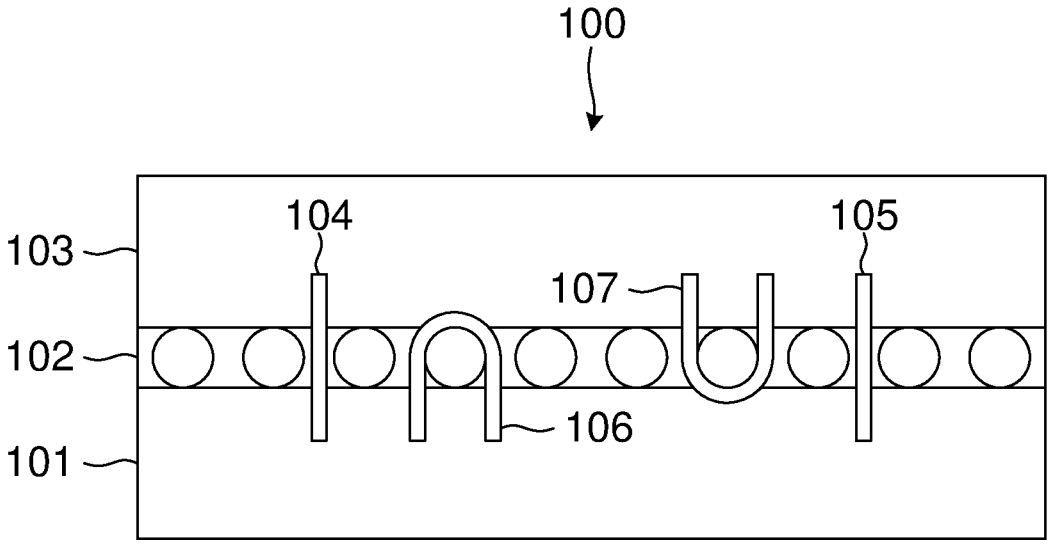
FIG. 1 is a cross-sectional view illustrating a layer structure of a deployable reflector for an antenna, according to an embodiment of the present invention.

In the following detailed description, only certain exemplary embodiments of the present invention have been shown and described, simply by way of illustration. As those skilled in the art would realise, the described embodiments may be modified in various different ways, all without departing from the scope of the present invention. Accordingly, the drawings and description are to be regarded as illustrative in nature and not restrictive. Like reference numerals designate like elements throughout the specification.

Referring now to FIG. 1, a cross-sectional view of a layer structure of a deployable reflector 100 for an antenna is illustrated, according to an embodiment of the present invention. The deployable reflector 100 comprises a first membrane 101, a second membrane 103, and an electrically conductive mesh 102. The electrically conductive mesh 102 is disposed between the first membrane 101 and the second membrane 103.

In the present embodiment the first membrane 101 is a deployable membrane. 'Deployable' means that the first membrane 101 can be collapsed into a compact stowed configuration, and subsequently unfolded into a deployed configuration. Antennas in which the reflector itself can be unfolded during deployment are commonly referred to as 'unfurlable' antennas. Accordingly, in embodiments of the present invention, the primary reflector of an unfurlable antenna may comprise the first membrane 101. The deployable membrane may also be referred to as an 'unfurlable' membrane. The first membrane 101 is configured to adopt a pre-formed shape in the deployed configuration. For example, to form a reflector for a parabolic antenna, the first membrane 101 can be pre-formed on a parabolic mould with the correct geometric properties. In the deployed configuration, the first membrane 101 may be capable of maintaining the reflector 100 in the desired three-dimensional shape by shaping the electrically conductive mesh 102.

The electrically conductive mesh 102 is disposed on a surface of the first membrane 101 such that in the deployed configuration, the conductive mesh 102 adopts the shape of the membrane 101 and forms a reflective surface of the reflector 100. The electrically conductive mesh 102 may be configured to permit relative lateral movement between the electrically conductive mesh 102 and the first and/or second membrane 101, 103 during deployment of the reflector. For example, the electrically conductive mesh 102 may be free to slide over the surface of the first and/or second membrane 101, 103 to permit relative lateral movement between the electrically conductive mesh 102 and said first and/or second membrane 101, 103. Alternatively, the surface of the electrically conductive mesh 102 may be connected to the adjacent surface of the first and/or second membrane 101, 103 by one or more adhesive or mechanical joints that permit relative lateral movement of the two surfaces during deployment. Such joints may also be referred to as linkages, connectors or tethers. Since the electrically conductive mesh 102 acts as the reflective surface and gives the reflector 100 the necessary reflective properties, it is not necessary for the first and second membranes 101, 103 to be formed of reflective material.

By permitting relative lateral movement, the deployable reflector can be made less susceptible to damage during deployment by reducing stresses in the mesh 102 and/or the first and second membranes 101, 103. Also, by permitting relative lateral movement between the mesh 102 and the first and/or second membranes 101, 103, the antenna can accommodate different rates of thermal expansion between the differing materials of the mesh 102 and the first and second membranes 101, 103 when the antenna is subjected to thermal cycling once deployed in space.

In the present embodiment the electrically conductive mesh 102 is arranged to be disposed on a convex surface of the deployable first membrane 101 in the deployed configuration, such that during deployment of the reflector 100 the first membrane 101 presses into and deforms the electrically conductive mesh 102 into the pre-formed shape. In this way, the electrically conductive mesh 102 can be placed under tension by the first membrane 101 in the deployed configuration, and tensile strain in the electrically conductive mesh 102 can assist in holding the mesh 102 against the convex surface of the first membrane 101 in the deployed configuration so that the mesh 102 adopts the same shape as the deployed first membrane 101.

In embodiments in which the electrically conductive mesh 102 is disposed on the convex side of the first 101 membrane, electromagnetic radiation received or transmitted by the antenna must pass through the first membrane 101 before being reflected by the electrically conductive mesh 102. In such embodiments the first membrane 101 can be formed of material that is RF transparent to electromagnetic radiation at radio-frequency (RF) wavelengths. Here, 'RF transparent' means that the first membrane 101 exhibits negligible losses and negligible additional reflections at RF wavelengths, such that the presence of the first membrane 101 has little or no impact on the performance of the antenna. By forming the first membrane 101 from a low RF loss material, the reflecting efficiency inherent to the conductive mesh 102 can be maintained.

In some embodiments, the electrically conductive mesh 102 and the deployable membrane 101, 103 may be arranged such that in use, incident electromagnetic radiation is reflected by the mesh 102 before reaching the membrane 101, 103. For example, in some embodiments the electrically conductive mesh 102 may be disposed on the concave surface of the deployable membrane 101, 103, such that incident electromagnetic radiation is reflected by the electrically conductive mesh 102 without passing through the deployable membrane 101, 103. In such embodiments the performance of the antenna may not be dependent on the RF properties of the deployable membrane 101, 103, and accordingly the deployable membrane 101, 103 may be formed from RF reflective material or from RF transparent material.

The second membrane 103 may also be a deployable membrane. In some embodiments the first and second membranes 101, 103 may be formed from the same material as each other and may have the same, or similar, thicknesses. For example, the first and/or second membrane 101, 103 may be formed from an open cell woven material. In other embodiments the first and second membranes 101, 103 may be formed from different materials to each other, and/or may have substantially different thicknesses. Providing a second membrane 103 can offer more accurate control over the shape of the reflector 100 in the deployed configuration. In some embodiments the second membrane 103 may be omitted.

The deployable reflector 100 of the present embodiment comprises a plurality of first connecting members 106, 107 connecting the mesh 102 to the first membrane 101 or the second membrane 103. In some embodiments a first connecting member 106, 107 may connect the mesh 102 to both the first membrane 101 and the second membrane 103. The first connecting members 106, 107 can be formed as adhesive or mechanical joints, as described above. Each first connecting member 106, 107 connects part of the mesh 102 to a point on the surface of the first or second membranes 101, 103, whilst permitting a certain amount of lateral movement between the mesh 102 and the first and second membranes 101, 103.

In the present embodiment each first connecting member 106, 107 comprises a flexible connector in the form of a loop, which is wrapped around one or more fibres of the mesh 102 and secures the one or more fibres to the first and/or second membrane 101, 103. For example, both ends of the loop may be embedded in a matrix material of the first or second membrane 101, 103 as shown in FIG. 1, or may pass through the membrane 101, 103 and be secured on an opposite side of the membrane 101, 103. In some embodiments, relative lateral movement may be permitted by making each loop 106, 107 from an elastic material capable of stretching to permit the mesh 102 to slide across the surface of the first or second membrane 101, 103. In some embodiments, relative lateral movement may be permitted by making each loop 106, 107 longer than a minimum distance required to encircle the one or more fibres of the mesh 102, such that a certain amount of slack is provided in the loop 106, 107 which can be taken up during lateral movement of the mesh 102 relative to the first or second membrane 101, 103.

In the present embodiment the deployable reflector 100 further comprises a plurality of second connecting members 104, 105 passing through the electrically conductive mesh 102. Each one of the plurality of second connecting members 104, 105 is connected to the first and second membranes 101, 103 so as to maintain a spacing between the first and second membranes 101, 103 during deployment of the reflector 100. For example, the second connecting members 104, 105 may be connected to the first and/or second membrane 101, 103 by embedding the ends of the second connecting members 104, 105 in the matrix of the membrane 101, 103 when forming the membrane 101, 103. Alternatively, recesses for receiving the second connecting members 104, 105 may be formed in a surface of one of the membranes 101, 103 during or after forming the membrane 101, 103, and the second connecting members 104, 105 may subsequently be secured in the recesses using suitable adhesive. As a further alternative, the second connecting members 104, 105 may be connected to the first and/or second membrane by suitable mechanical means. For example, a thread may be formed on an end of each second connecting member 104, 105, which may pass through a hole in one of the membranes 101, 103 to allow the second connecting member 104, 105 to be secured by a nut screwed on to the thread.

The second connecting members 104, 105 tie the first and second membranes 101, 103 together to prevent the first and second membranes 101, 103 from moving apart from one another as the reflector 100 is deployed. The second connecting members 104, 105 help to prevent faceting and pillowing in the electrically conductive mesh 102 by ensuring that the mesh 102 remains tightly held between the first and second membranes 101, 103. In embodiments in which a second membrane 103 is omitted, the second connecting members 104, 105 may be omitted. Furthermore, in embodiments in which the second membrane 103 is omitted and first connecting members 106, 107 are provided, the first connecting members 106, 107 may only connect the mesh 102 to the first membrane 101.

Figure 2:
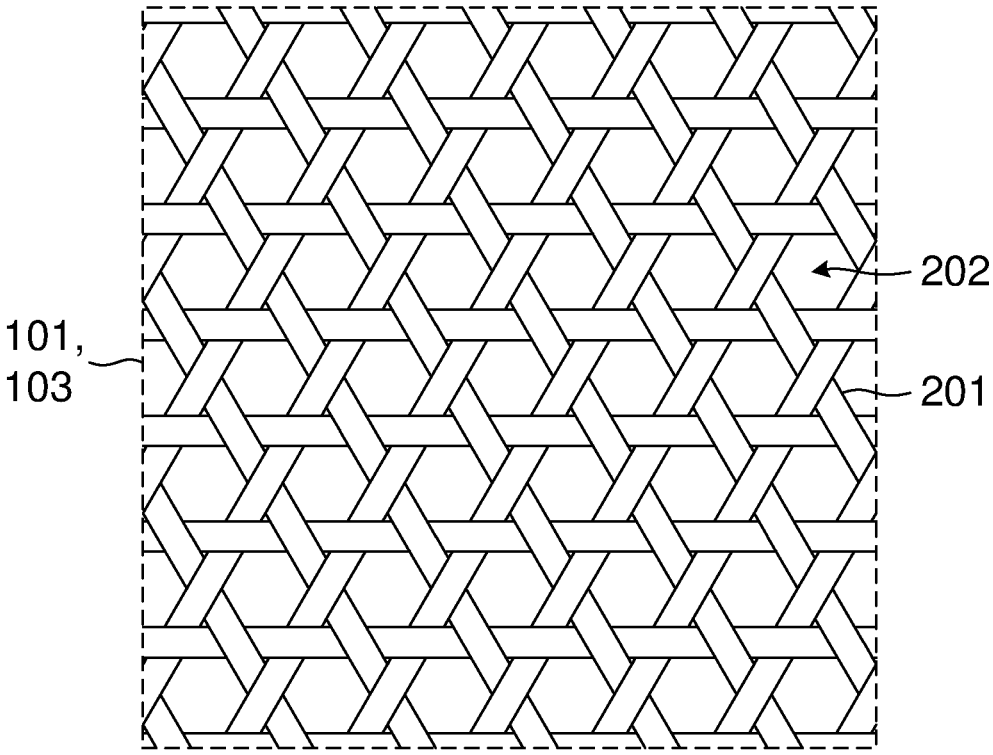
FIG. 2 illustrates a triaxial weave structure of a membrane layer in the deployable reflector of FIG. 1, according to an embodiment of the present invention.

Referring now to FIG. 2, a triaxial weave structure of a membrane layer in the deployable reflector of FIG. 1 is illustrated, according to an embodiment of the present invention. The structure shown in FIG. 2 may be used for one or both of the first and second membranes 101, 103 in FIG. 1. In the present embodiment the membrane layer 101, 103 comprises an open-cell woven material which has a triaxial weave structure. The woven material comprises a plurality of woven fibres 201 orientated along three principal axes. The fibres 201 may be embedded in a matrix material 202. In the present embodiment, a triaxial weave of para-aramid fibres 201 embedded in a silicone matrix 202 is used. For space applications, a space-grade silicone may be used for the matrix 202.

Triaxial weave materials are capable of being formed into any arbitrary three-dimensional shape, and so can accurately conform to the contours of a mould on which the first or second membrane 101, 103 is formed. However, due to the open-cell structure, triaxial weave materials generally have poor reflective properties, particularly at RF wavelengths. Accordingly, in some embodiments of the present invention a triaxial weave material can be combined with an electrically conductive mesh to provide a reflector which exhibits accurate shape control in the deployed configuration together with low RF losses.

In other embodiments the membrane may be formed from another suitable material other than triaxial weave, for example a knitted fabric. The membrane may be formed from material that exhibits high drapability. Here, 'drapability' is used in the conventional sense to refer to the ability of a material to deform under its own weight.

A material with high drapability can be capable of forming complex three-dimensional curved shapes without creasing. The drapability of a material may be quantified using the drape coefficient (DC), wherein a material with high drapability has a low DC, indicating that the material can easily deform over complex curves without creasing. The maximum acceptable DC for the material from which the membrane is formed may vary between embodiments, according to the particular pre-formed shape that the membrane is required to adopt. For example, in embodiments of the invention the membrane may comprise a material with sufficiently high drapability to be able to deform into the desired pre-formed shape without creasing.

Figure 3:
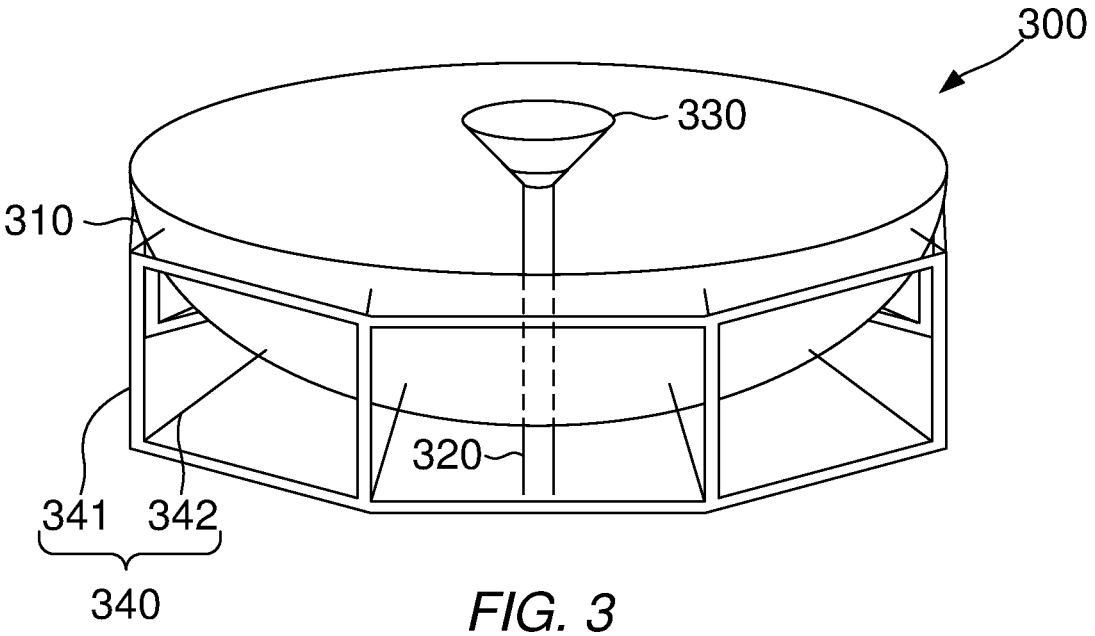
FIG. 3 illustrates a reflector antenna comprising a deployable reflector, according to an embodiment of the present invention.

Referring now to FIG. 3, a reflector antenna 300 comprising a deployable reflector 310 is illustrated, according to an embodiment of the present invention. The reflector antenna 300 comprises the deployable reflector 310, an antenna feed 320, and a secondary reflector 330. In this embodiment, the deployable reflector 310 forms the primary reflector of the antenna 300. In other embodiments the secondary reflector 330 may be omitted, such that the primary reflector 310 directs the beam directly into the antenna feed 320.

In the present embodiment, the membrane 101 of the deployable reflector 310 is configured to provide a continuous three-dimensional curved surface for supporting the electrically conductive mesh 102 in the deployed configuration.

By 'continuous', it is meant that all areas of the electrically conductive mesh 102 are supported by part of the membrane 101. Using a continuous membrane 101 can provide the most accurate control over the shape of the reflector 310 in the deployed configuration.

However, in other embodiments some parts of the electrically conductive mesh 102 may not be directly supported by an underlying membrane 101. For example, in some embodiments the membrane 101 may include one or more apertures for reducing the overall mass of the antenna 300, with the conductive mesh 102 spanning the aperture to provide a continuous reflective surface. Such an arrangement may be used in applications where it is necessary to reduce the mass of the antenna as far as is possible, and in which a decrease in performance due to the loss of accurate shape control in the region of the aperture is an acceptable compromise.

The antenna 300 may also comprise a backing structure 340 for automatically deploying the reflector 310. For example, the backing structure 340 may comprise an elastic frame 341 anchored to the reflector 310 at certain points via cables 342. The elastic frame 341 can be folded into a compact stowed configuration, along with the deployable reflector 310. When a restraining force on the backing structure 340 is released, the elastic frame 341 automatically unfolds and pulls the deployable reflector 310 into the deployed configuration. Backing structures for deploying and supporting reflectors are known in the art, and a detailed description will not be provided here so as not to obscure the present inventive concept.

Conventional backing structures are highly complex, as the structure is required to hold the reflector in the desired shape once deployed. In contrast, in embodiments of the present invention a deployable reflector comprises a membrane which automatically adopts the desired shape of the reflector. In this way, the shape of the reflector 310 in the deployed configuration can be controlled by the self-supporting membrane 101, 103, instead of being controlled by the backing structure 340.

In embodiments of the present invention, the backing structure 340 is therefore not required to accurately control the shape of the reflector 310 once deployed, and only needs to apply sufficient force to unfold the reflector 310. Accordingly, the complexity of the backing structure can be significantly reduced in comparison to conventional designs, reducing the overall size and mass of the antenna assembly comprising the reflector 310 and the backing structure 340. It will also be appreciated that since the membrane automatically adopts the pre-formed shape in the deployed configuration, the electrically conductive mesh layer 102 does not suffer from pillowing or faceting, in contrast to conventional deployable mesh-based antennas in which the shape of the mesh is controlled by a complex cable network structure.

Furthermore, although a backing structure 340 for deploying the reflector 310 is illustrated in FIG. 3, in some embodiments the backing structure 340 may be omitted. For example, in some embodiments the elastic strain energy stored in the stowed reflector 310 may be sufficient to cause the reflector to automatically unfold and deploy, particularly in zero-gravity environments. Furthermore, in some embodiments the first membrane 101, and/or the second membrane 103 if present, may be capable of supporting the reflector 100 in the desired pre-formed shape in the deployed configuration, and hence may be referred to as a 'self-supporting' membrane. However, if the reflector 310 is to remain in the stowed configuration for a relatively long time period, matrix creep may reduce the total elastic energy stored in the self-supporting membrane 101, 103. Accordingly, a backing structure 340 may be provided to be certain that sufficient force will be available to deploy the reflector 310.

Figure 4:
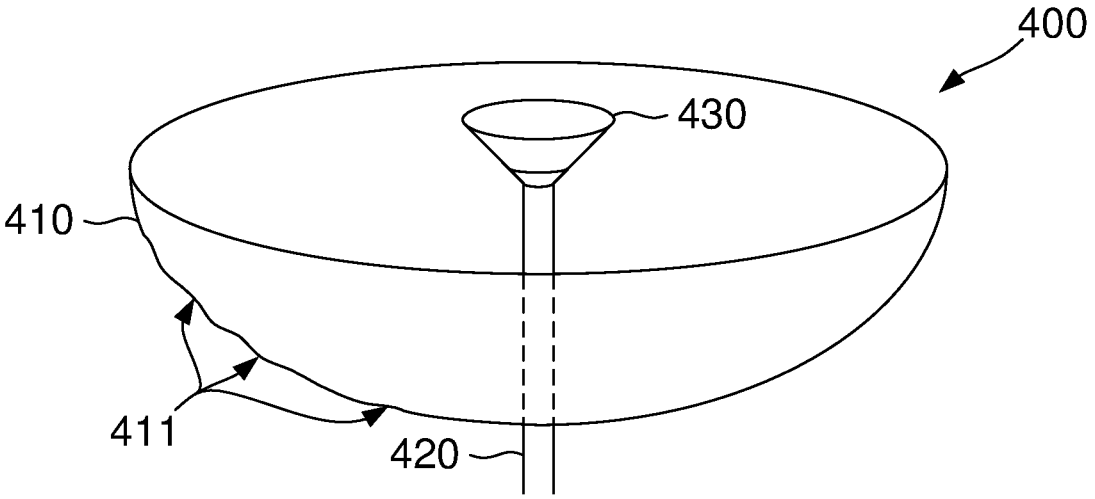
FIG. 4 illustrates a contoured-beam antenna comprising a deployable shaped reflector, according to an embodiment of the present invention.
Figure 5:
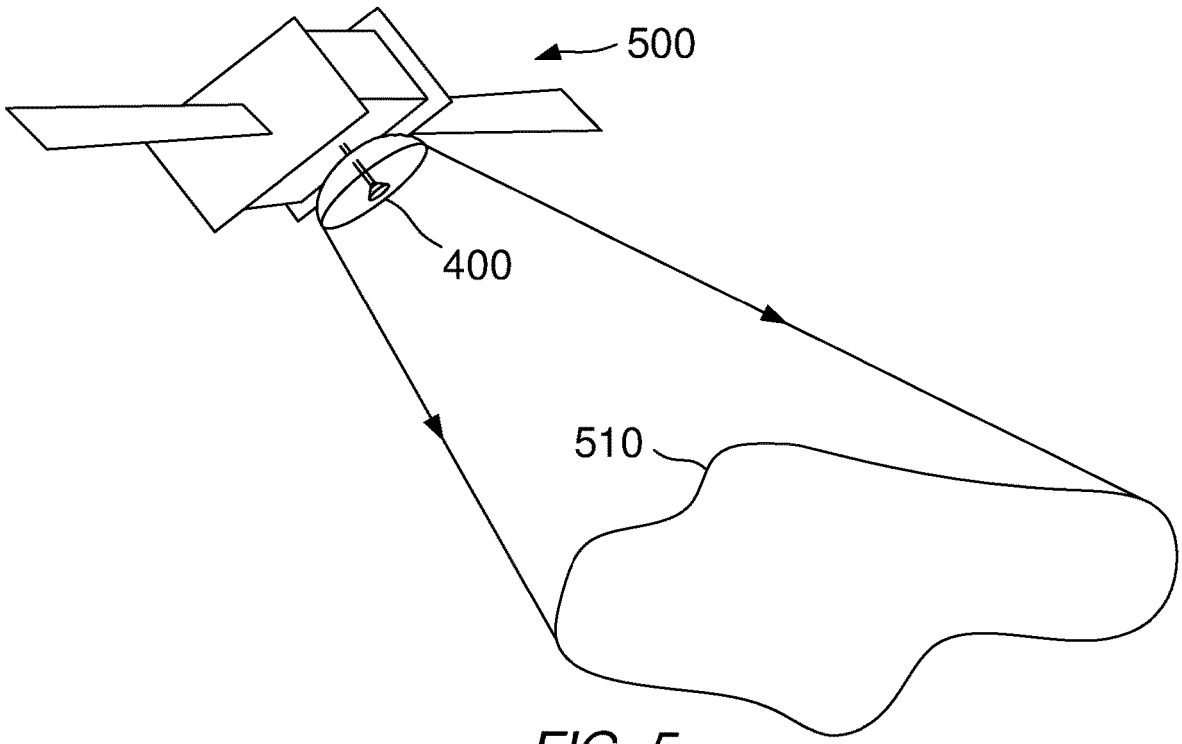
FIG. 5 illustrates a satellite comprising the contoured-beam antenna of FIG. 4, according to an embodiment of the present invention.

Referring now to FIG. 4, a contoured-beam antenna 400 comprising a deployable shaped reflector 410 is illustrated, according to an embodiment of the present invention. Like the reflector antenna 300 of FIG. 3, the contoured-beam antenna 400 also comprises an antenna feed 420 and a secondary reflector 430. In the present embodiment the shaped reflector 410 is substantially parabolic, but includes a plurality of regions of different curvatures 411 so as to produce a beam having an irregular pattern. The regions of different curvature 411 can be configured to produce a beam with any desired shape, for example to allow the reflector to be focused on specific countries and continents. FIG. 5 illustrates a satellite 500 comprising the contoured-beam antenna 400, in which a downlink beam 510 with an irregular pattern is produced.

Previously, conventional shaped reflectors have only been achieved in solid dish architectures using complex manufacturing methods. In the embodiment shown in FIG. 4, a shaped reflector is achieved by combining a deployable membrane 101, 103 with an electrically conductive mesh 102 as shown in FIG. 1. The arbitrarily shaped pre-formed membrane 101, 103 distorts the metal mesh 102 into the same shape as the pre-formed membrane 101, 103 in the deployed configuration, thus achieving a shaped deployable reflector 410. For example, a triaxial weave material as shown in FIG. 2 may be used to form an arbitrarily shaped pre-formed membrane. Triaxial weave is particularly suitable for use in deployable shaped reflectors such as the one illustrated in FIG. 4, since triaxial weave is capable of being formed into complex shapes.

Figure 6:
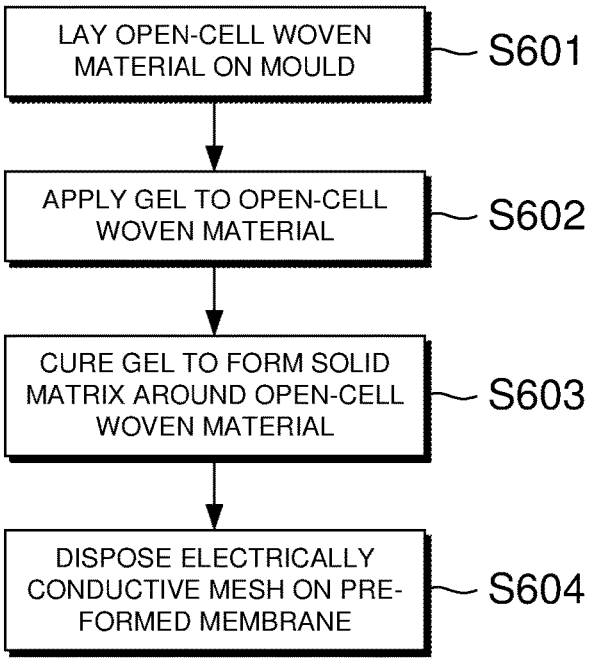
FIG. 6 is a flowchart showing a method of manufacturing a deployable reflector for an antenna, according to an embodiment of the present invention.

Referring now to FIG. 6, a flowchart showing a method of manufacturing a deployable reflector for an antenna is illustrated, according to an embodiment of the present invention. The method involves pre-forming a deployable membrane on a mould, followed by disposing an electrically conductive mesh on the membrane. Consequently, in the deployed configuration, the conductive mesh will adopt the shape of the membrane and can act as the reflective surface in an antenna.

First, in step S601 an open-cell woven material is laid on the mould. For example, a triaxial weave may be used, as described above with reference to FIG. 2. Next, in step S602 a gel is applied to the open-cell woven material, for forming the matrix. Depending on the embodiment, the gel may be applied before or after laying the open-cell woven material on the mould. Therefore in some embodiments, step S602 may be performed before step S601. Then, in step S603 the gel is cured to form a solid matrix around the open-cell woven material, whilst the membrane remains on the mould. In this way, the membrane is pre-formed so as to automatically adopt the same shape as the mould in the deployed configuration. Then, in step S604 the electrically conductive mesh is then disposed on the membrane in such a way as to permit relative lateral movement between the electrically conductive mesh and the membrane during deployment of the reflector, as described above.

Whilst certain embodiments of the invention have been described herein with reference to the drawings, it will be understood that many variations and modifications will be possible without departing from the scope of the invention as defined in the accompanying claims.

The invention claimed is:

1. A deployable reflector for an antenna, the deployable reflector comprising:

a self-supporting deployable membrane having a pre-formed shape such that, in use, the membrane automatically adopts the pre-formed shape in a deployed configuration;

an electrically conductive mesh disposed on a surface of the membrane such that in the deployed configuration, the conductive mesh adopts the pre-formed shape of the membrane and forms a reflective surface of the reflector; and a plurality of first connecting members connecting the mesh to the membrane, wherein each of the first connecting members comprises a flexible connector in the form of a loop wrapped around one or more fibres of the mesh, and is configured to permit relative lateral movement between the electrically conductive mesh and the membrane during deployment of the reflector, wherein said relative lateral movement comprises movement across a surface of the membrane, and wherein the plurality of first connecting members are configured to permit said relative lateral movement between the electrically conductive mesh and the membrane after the deployable reflector has been deployed.

2. The deployable reflector of claim 1, wherein the membrane comprises an open-cell woven material.

3. The deployable reflector of claim 2, wherein the open-cell woven material has a triaxial weave structure.

4. The deployable reflector of claim 2, wherein the open-cell woven material comprises a weave of para-aramid fibres embedded in a silicone matrix.

5. The deployable reflector of claim 1, wherein the electrically conductive mesh is arranged to be disposed on a convex surface of the deployable membrane in the deployed configuration, such that during deployment of the reflector the deployable membrane presses into and deforms the electrically conductive mesh into the pre-formed shape.

6. The deployable reflector of claim 5, wherein the membrane is formed of material that is transparent to electromagnetic radiation at radio-frequency wavelengths.

7. The deployable reflector of claim 1, wherein each first connecting member is formed of an elastic material capable of stretching to permit relative lateral movement between the mesh and the membrane.

8. The deployable reflector of claim 1, wherein a length of the loop in each first connecting member is longer than a minimum distance required to encircle the one or more fibres of the mesh, such that slack in the loop can be taken up during relative lateral movement between the mesh and the membrane.

9. The deployable reflector of claim 1, wherein said membrane is a first membrane, and the electrically conductive mesh is disposed between the first membrane and a second membrane.

10. The deployable reflector of claim 9, further comprising:

a plurality of second connecting members passing through the electrically conductive mesh, each one of the plurality of second connecting members being connected to the first and second membranes to maintain a spacing between the first and second membranes during deployment of the reflector.

11. The deployable reflector of claim 1, wherein the membrane is configured to provide a continuous three-dimensional curved surface for shaping the electrically conductive mesh in the deployed configuration.

12. The deployable reflector of claim 11 configured as a shaped reflector for a contoured-beam antenna, wherein in the deployed configuration the three-dimensional curved surface of the membrane includes a plurality of regions of different curvatures so as to produce a beam having an irregular pattern.

13. The deployable reflector of claim 1, included in an unfurlable antenna.

14. The deployable reflector of claim 13, wherein the unfurlable antenna comprises:

a backing structure configured to deploy the deployable reflector.

15. A satellite comprising the deployable reflector of claim 13.

16. A method of manufacturing a deployable reflector for an antenna, the method comprising:

pre-forming a deployable self-supporting membrane on a mould so that the membrane has a pre-formed shape, such that, in use, the membrane automatically adopts the shape of the mould in a deployed configuration;

disposing an electrically conductive mesh on the self-supporting membrane such that in the deployed configuration, the conductive mesh adopts the pre-formed shape of the membrane and forms a reflective surface of the reflector; and connecting the mesh to the membrane by a plurality of first connecting members, wherein each of the first connecting members comprises a flexible connector in the form of a loop wrapped around one or more fibres of the mesh, and is configured to permit relative lateral movement between the electrically conductive mesh and the membrane during deployment of the reflector, wherein said relative lateral movement comprises movement across a surface of the membrane, and wherein the plurality of first connecting members are configured to permit said relative lateral movement between the electrically conductive mesh and the membrane after the deployable reflector has been deployed.

17. The method according to claim 16, wherein pre-forming the deployable membrane comprises:

laying an open-cell woven material on the mould;

applying a gel to the open-cell woven material, before or after laying the open-cell woven material on the mould; and curing the gel to form a solid matrix around the open-cell woven material, whilst the membrane remains on the mould.

18. A satellite comprising the deployable reflector of claim 14.

* * * * *